United States Patent [19]

Schwarz

[11] Patent Number: 4,700,774

[45] Date of Patent: Oct. 20, 1987

[54] OIL COOLER

[75] Inventor: Gebhard Schwarz, Stuttgart, Fed. Rep. of Germany

[73] Assignee: Sueddeutsche Kuehlerfabrik Julius F. Behr. GmbH, Stuttgart, Fed. Rep. of Germany

[21] Appl. No.: 436,384

[22] Filed: Oct. 25, 1982

[30] Foreign Application Priority Data

Oct. 23, 1981 [DE] Fed. Rep. of Germany ..... 3142028

[51] Int. Cl.[4] ..... F28D 9/02; F28D 1/02; F28F 3/14

[52] U.S. Cl. ..... 165/140; 165/152; 165/170; 165/916

[58] Field of Search ..... 123/41.33, 41.51; 165/141, 152, 170, DIG. 23, 166, 150, 164, 165, 140; 29/157.3 D, 157.3 V

[56] References Cited

U.S. PATENT DOCUMENTS

| | | | |
|---|---|---|---|
| 1,015,404 | 1/1912 | Schewczik | 165/170 |
| 1,110,065 | 9/1914 | Linga | 165/164 |
| 1,945,287 | 1/1934 | Monroe | 165/DIG. 23 |
| 1,946,496 | 2/1934 | Kleist | 165/135 |
| 2,195,259 | 3/1940 | Ramsaur | 165/170 |
| 2,222,721 | 11/1940 | Ramsaur et al. | 165/DIG. 23 |
| 2,306,526 | 12/1942 | Dalzell et al. | 29/157.3 V |
| 2,617,634 | 11/1952 | Jendrassik | 165/166 |
| 2,646,258 | 7/1953 | Freer | 165/166 |
| 2,657,018 | 10/1953 | Simpelaar | 165/170 |
| 2,782,008 | 2/1957 | Caughill | 165/166 |
| 2,796,239 | 6/1957 | Holmes et al. | 165/164 |
| 2,848,200 | 8/1958 | Jacobs | 165/170 |
| 2,884,768 | 5/1959 | Gould | 29/157.3 V |
| 4,004,634 | 1/1977 | Habdas | 165/141 |
| 4,286,365 | 9/1981 | Creighton | 165/170 |

FOREIGN PATENT DOCUMENTS

| | | | |
|---|---|---|---|
| 533733 | 12/1954 | Belgium | 165/170 |
| 536300 | 3/1955 | Belgium | 165/170 |
| 0023664 | of 1895 | United Kingdom | 165/166 |
| 960975 | 6/1964 | United Kingdom | 165/170 |
| 974470 | 11/1964 | United Kingdom | 165/165 |

*Primary Examiner*—Albert W. Davis, Jr.
*Assistant Examiner*—John K. Ford
*Attorney, Agent, or Firm*—Barnes & Thornburg

[57] ABSTRACT

The invention relates to an oil cooler, especially for cooling the transmission oil of a motor vehicle, which includes a guide channel for the oil to be cooled extending in a region where it is subjected to a cross-flow of a cooling medium. The oil guide channel is constructed with two walls of folded, curved sheet metal, between which walls the oil is guided. The folded sheet metal cooler construction offers an improved heat exchange capacity as compared to previously used double pipe or double tube coolers. In especially advantageous embodiments of the invention, the oil is restrictively guided through the folded sheet metal cooler body so that a long path or passage for the flow-through of the oil results, whereby the heat exchange capacity is yet further increased.

4 Claims, 5 Drawing Figures

OIL COOLER

BACKGROUND AND SUMMARY OF THE INVENTION

The invention relates to an oil cooler, especially for cooling the transmission oil of a motor vehicle, of the type with a channel guide for guiding the oil to be cooled through a cooling region or zone.

It has been contemplated to provide a double pipe cooler with a double pipe extending in a water tank of a motor vehicle for the cooling of the vehicle transmission oil (German DE-PS No. 1104542). In this arrangement, the region between the respective inner and outer pipes of the double pipes serve as the oil guide channel. The double pipe is subjected to flow from the cooling water led to the water tank. In this way the oil is cooled in the double pipe. The cooling capacity is decisively dependent upon the area over which the heat exchange takes place. The length of the oil travel path through the cooling region also influences the capacity of the oil cooler. These dimensions can however not be arbitrarily chosen, especially for construction of an oil cooler for motor vehicles where only limited space is available. Thus one must strive to achieve the largest possible exchange capacity using the smallest available space.

It has been proposed to increase the heat exchange capacity by providing several double pipes arranged immediately adjacent one another in a triangle with parallel extending axes, whereby the exchange capacity as compared to an oil cooler with a single double pipe is increased (German DE-OS No. 2822743). In spite of this last mentioned proposed arrangement, the resultant heat exchange capacity is insufficient for all cases. A further increase in capacity can however not be reached with the known double pipe coolers without an increase in the required construction space. Furthermore, due to the manufacturing processes it is difficult to control variations in the exchange capacity of the double pipe exchangers.

The invention is based upon the problem of developing an oil cooler, especially for the cooling of transmission oil of a motor vehicle, which avoids the above mentioned disadvantages and also makes possible a high heat exchange capacity with only small usable building space, and which increases the heat exchange capacity as compared to the prior arrangement with the utilization of a comparable building space.

The invention proposes to construct the oil guidance channel as a double walled wave-form shape folded sheet-metal housing, between which walls the oil is guided. Such a wave formed or zig-zagged formed body exhibits a significantly greater heat exchange area and therefore makes an increase in the efficiency possible as compared to the known double pipe or tube coolers, occupying the same construction volume. Further, the oil stream can be very efficiently guided through the sheet metal body. The construction is made relatively simple and also the material needed is less than for a double pipe cooler with comparable capacity.

A further advantage is obtained if the sheet metal body is constructed so as to define a restricted path for the oil. In this way the oil is led along the longest possible path through the heat exchange body so that the oil remains a relatively long time in the cooling region and is therefore efficiently cooled.

It is especially advantageous for the construction of the oil cooler if the sheet metal body is formed of two corresponding walls which are connected on their edges with each other by crimping or soldering. The connection together of the two walls can be made before or after the folding of the walls to form the wave shaped corrugations. The restricted guidance of the oil can be accomplished in an advantageous way through the pressing together and soldering of the two walls of the sheet metal body in specific positions over the length of the body or such that the so constructed seams extend alternately over a part of the width of the sheet metal walls. Through this construction the oil is guided in a zig-zag course through the sheet metal body which itself is also wave shaped or corrugated, so as to exhibit a long travel path for the oil.

It is furthermore advantageous when a turbulance inducing device is placed in the sheet metal housing. This turbulence device serves to swirl the through-flowing oil stream and thereby to increase the heat exchange coefficient. These turbulence devices have also the function to hold both walls of the folded sheet metal at a distance from one another. For this last mentioned purpose, according to other preferred embodiments, separating cams or lugs are inserted between the walls which prevent impairment of the through flow of the oil which could be otherwise caused by the formation of narrow passages in the body during disturbance of the walls during the folding process. Further embodiments of the invention include through flow openings for a cooling medium provided through the seams. These openings make it possible for the through flow of the cooling medium whereby the heat exchange of the oil cooler is promoted.

To further promote the increase in the heat exchange it is advantageous if the oil cooler is arranged at the connection pipes in a water tank of an air cooled motor vehicle radiator. It is especially preferred that the oil cooler is arranged in the region of the incoming water connection and is disposed in the stream of the cooling water flow transverse to the zig-zag folds. In this way the inflowing cooling water impinges directly onto the oil cooler so that an efficient impact stream results which promotes the heat exchange. The connection fittings can be arranged on the same sheet metal body segment of the oil cooler so that a simple construction in the water tank is possible.

According to yet other preferred embodiments the oil cooler of the invention is used not only in a water tank but rather in a cooling air stream whereby ribs can be provided between the segments of the sheet metal body to increase the heat exchange. Many of the same advantages of the higher exchange capacity with optimal utilization of the building space are also obtained with such air cooled arrangements. The sheet metal body would then be subjected to a flow of cooling air along the direction of the zig-zag folding area.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
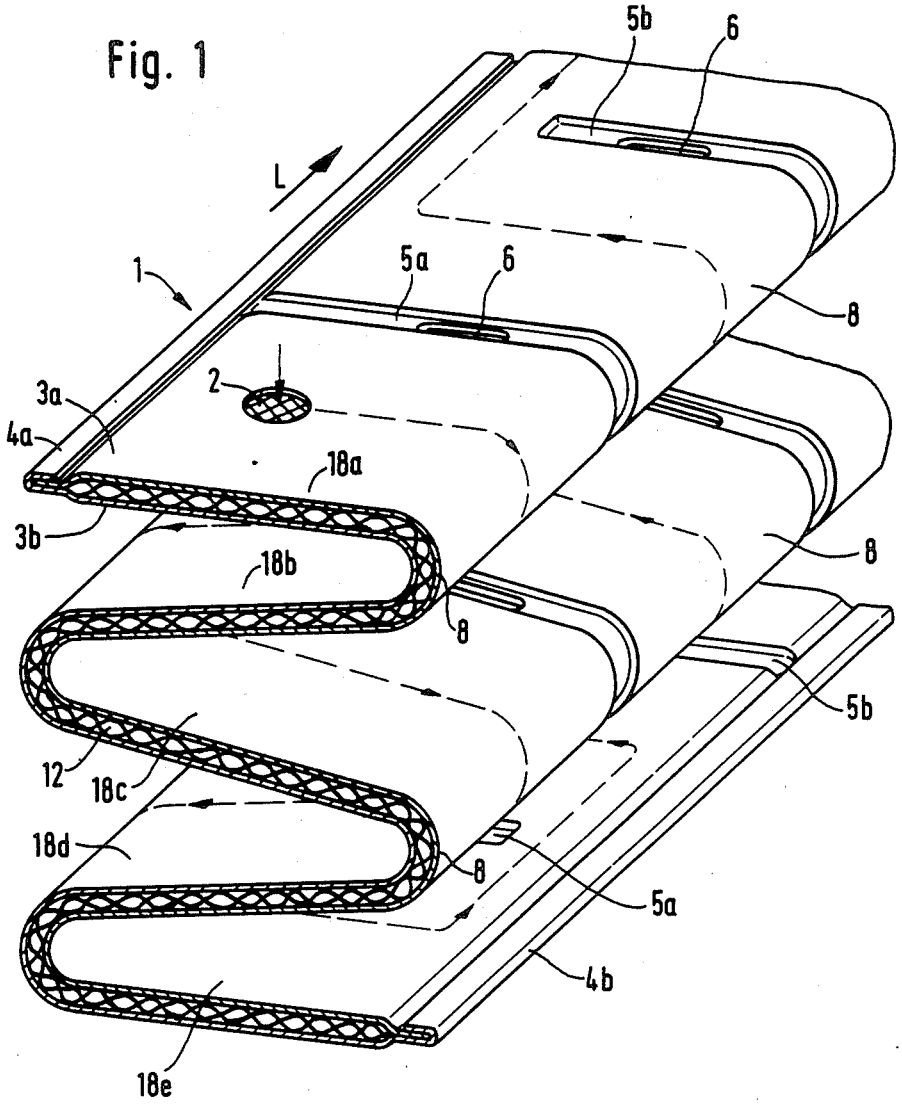
FIG. 1 is a perspective view of a section of an oil cooler constructed in accordance with the invention.

FIG. 1 illustrates a portion of a sheet metal body which, along with the unillustrated connecting fittings, forms an oil cooler constructed in accordance with the present invention.

The sheet metal body 1 is formed of two corresponding zig-zag formed folded walls 3*a* and 3*b*, spaced from one another to accommodate the flow through of oil to be cooled. The sheet metal cooler body 1 exhibits separate sheet metal body segments 18*a* through 18*e* with respective relatively large heat exchange surfaces. Along the borders 4*a* and 4*b*, both walls 3*a* and 3*b* of the sheet metal body 1 are crimped together and further connected by soldering to form a reliable, fluid tight connection between the two walls. When a cooling body 1 of this form is placed into the cooling region of a cooling medium, whether it be a cooling water medium or cooling air, the flow on the resulting heat exchange areas results in a good heat exchange efficiency.

This efficiency is further enhanced by providing that the oil flowing through the inlet opening 2 into the channel guide between the two walls 3*a* and 3*b* is subjected to a restricted guidance so that it flows through the longest possible path through the cooler body. For this path restriction, baffles are provided in the form of seams 5*a* and 5*b* at specific distances from one another, which seams are formed through the pressing together and soldering of the two walls 3*a* and 3*b* together. With this construction, the oil is forced to move also in the longitudinal direction L of the sheet metal body 1 and to travel through a zig-zag course, with a resultant long path. The seams are so constructed that they extend transversely to the longitudinal direction of one wall border or edge 4*a* up to a distance to the other edge 4*b* and vice versa. In this way the zig-zag guidance of the oil is obtained in a simple manner. The seam at position 5*a* ends at a distance from the edge 4*b* so that the oil is led first from the opening 2 in the direction toward the edge 4*b* along the wave-like folds and then in the region between the seam 5*a* and the edge 4*b* the oil is guided in the longitudinal direction L and then because of the restrictive guide seam 5*b* of the folded cooler, it further flows in the upward direction until it is at the position between the edge 4*a* and the end of the seam 5*b* at which point it is further guided in the longitudinal direction L.

In order to improve the swirling of the oil stream, a turbulence sheet or device 12 is provided between the two walls 3*a* and 3*b*, which furthermore forms the function of supporting the two walls 3*a* and 3*b* spaced from one another. Spacing cams 9 can also be placed between the walls 3*a* and 3*b* in place of the turbulence sheet, as illustrated in figure 2 (exemplarily shown only over a portion of the cooler housing body between seams 5*c* and 5*b*).

Figure 2:
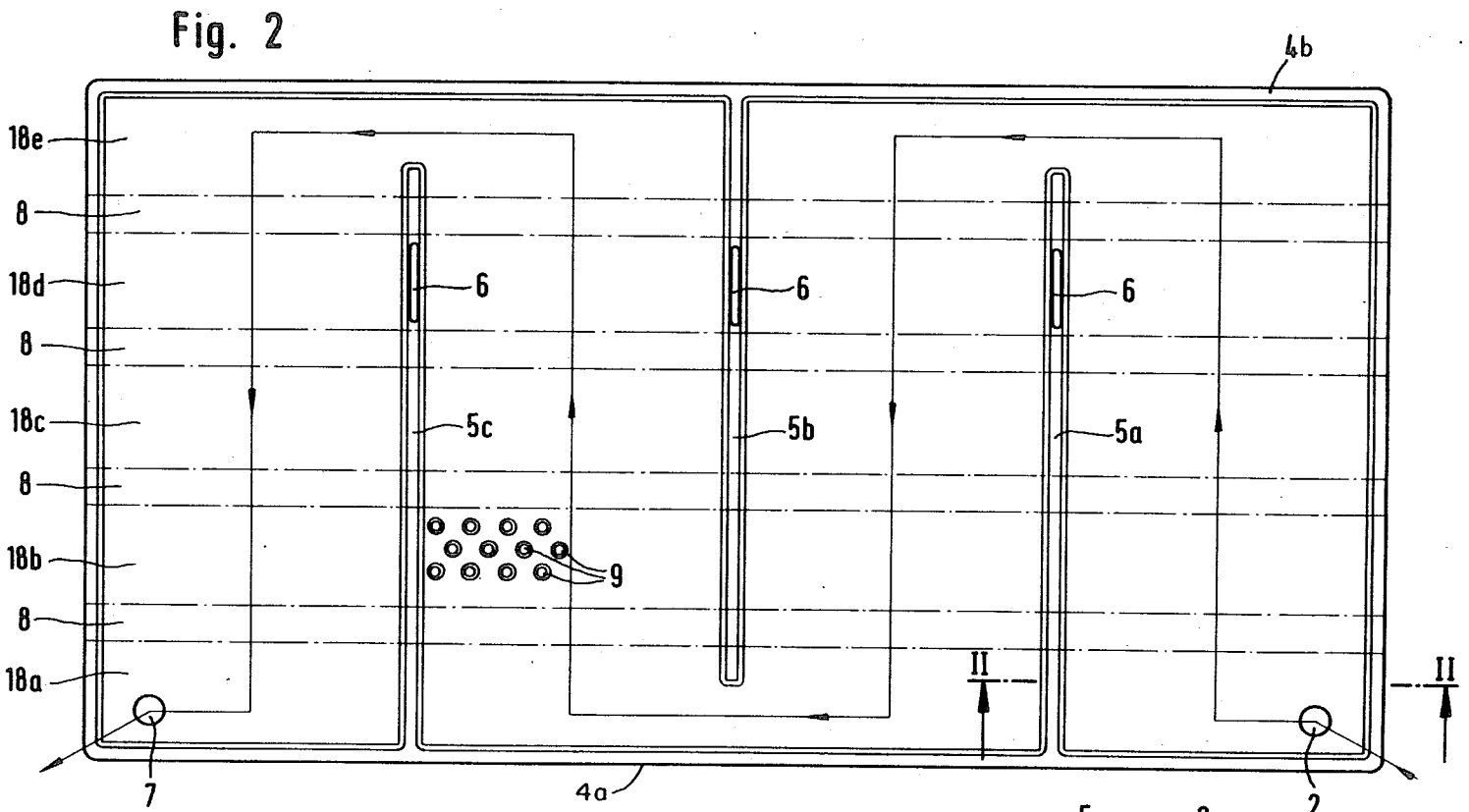
FIG. 2 is a top view of a sheet metal plate to be used for the construction of the oil cooler of FIG. 1, in a position prior to the folding thereof.

FIG. 2 is a schematic illustration showing the top view of the top sheet metal plate 3*a* prior to the folding of same to form the cooler body 1 illustrated in FIG. 1. A line with arrows illustrates the restricted flow of the oil from the inlet opening 2 through the restricted path defined by the seam dividers 5*a*, 5*b*, and 5*c* to the outlet opening 7. For the manufacture of the folded cooler, the two walls 3*a* and 3*b*, which both exhibit a form as illustrated in FIG. 2, are laid one on the other and the edge regions are crimped together and soldered. Along the seams 5*a*, 5*b*, and 5*c*, toward the top of the cooler body 1 (compare FIG. 1 — seam 5*c* not shown is to the left of 5*a* and 5*b*), openings 6 are provided for accommodating through flow of the cooling medium so as to result in a suitable flow across and along the course of the oil cooler.

Figure 2A:
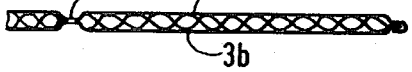
FIG. 2*a* is a part sectional view along line II—II of FIG. 2.

The walls 3*a* and 3*b* which are lain one on top of the other and are sealingly connected at their edge regions 4*a* and 4*b* and along the seams 5*a*, 5*b*, and 5*c* are then folded so as to form the folded regions 18*a* through 18*e*, along the folding locations 8 as shown in FIG. 1 and 2. In order to prevent the touching of the two walls together during the folding operation along the folding locations 8, either the above noted turbulence sheets 12 or the spacing lugs 9 are provided (compare FIG. 2). FIG. 2a shows a cross sectional view along the line II—II of the region of seam 5*a*, from which it can be seen that in this region the walls 3*a* and 3*b* are sealingly connected to one another.

The number of the bending regions 8 as well as the number of the seams 5*a*, 5*b*, 5*c* can be varied in dependence upon the available building volume and desired operation.

Figure 3:
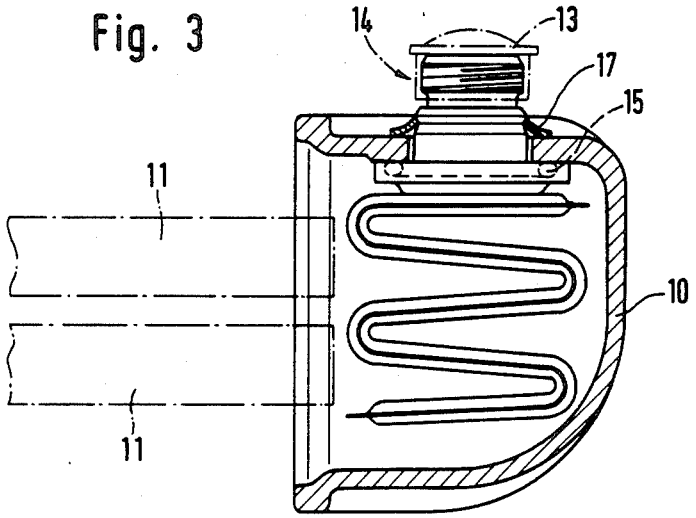
FIG. 3 is a side view of an oil cooler of the invention arranged in a water tank of a motor vehicle.

The oil cooler corresponding to the arrangement of FIG. 1 can be placed in a water tank of an air cooled radiator of a motor vehicle, the wall 10 of which is shown in section in FIG. 3. There is also shown an oil inlet connection fitting 13 which is affixed to the oil flow inlet opening 2 of the oil cooler. A corresponding not illustrated outlet fitting is affixed to the oil flow outlet 7. The inlet connection fitting 13 and the outlet fitting are connected to the folding segment 18*a* at the respective two end regions thereof. The folded sheet metal segment 18*a* is welded or soldered to the underside of the fitting 13 so that the hole in the fitting 13 and the opening 2 are disposed in close alignment underneath one another.

For fixing the inlet connection 13 in position at the water tank, the oil cooler is placed in the water tank and fitting 13 is placed through an opening in the water tank and then by means of a nut 14 and collar 17, which collar lays on the upper side of the water tank, fitting 13 is pulled upwards so that the lower region of the inlet fitting 13 is pressed against the o-ring 15 thereby preventing the outflow of water from the water tank. The inlet of the cooling water through the pipe 11 results in a cooling stream flowing diagonally to the zig-zag folding of the folding area of the cooler so that an impingement flow enhances the heat exchange. The oil outlet fitting connection is connected in a similar manner to outlet opening 7 of the cooler and is fastened in a corresponding manner at another opening of the water tank, thus the same is not further described herein.

Due to the relatively small construction volume that is available in such a radiator water tank, the inventive oil cooler of the present invention offers the advantage of a maximally long heat exchange path for the cooling oil and a large heat exchange surface so that the exchange capacity as compared to the known double pipe coolers is substantially increased. (An increase of the heat exchange area of about 80 per cent as compared to the double pipe cooler occupying the same space is possible.)

Figure 4:
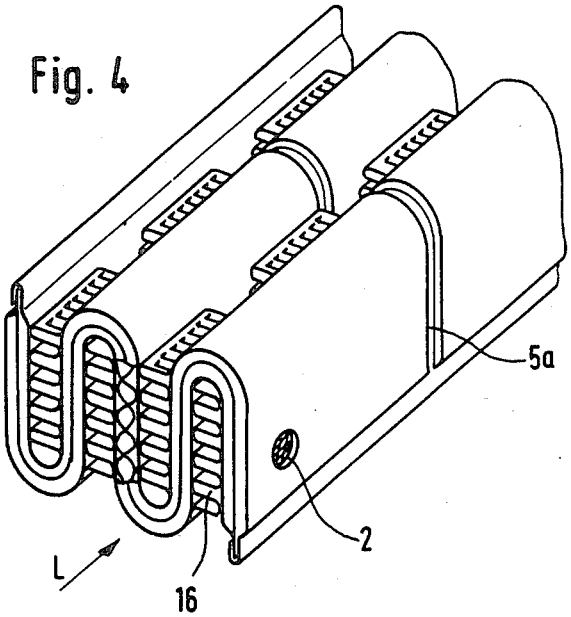
FIG. 4 is a perspective view of a section of an oil cooler constructed according to the invention for use with a cooling air stream.

The utilization of the inventive sheet metal folded oil cooler is not only possible in water tanks, it can also be used in an air stream such as shown in FIG. 4 at L. The cooling air stream flows over the zig-zag folds in the longitudinal direction and is guided between the segments 18*a* to 18*e* of the folded sheet metal cooler by means of ribs 16 with breathing openings, provided so that the turbulance and therewith the heat exchange is increased. The ribs 16 function to also serve as stiffening support for the cooler and prevent deformation which may be caused by the heating influence or by the internal pressure.

While we have shown and described several embodiments in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

What is claimed is:

1. An oil cooling arrangement for cooling transmission oil in motor vehicles, comprising a water tank of a cooling radiator and an oil cooler disposed in said water tank of a cooling radiator and an oil cooler disposed in said water tank, wherein said oil cooler comprises:

a sheet metal body formed by two adjacent facing walls which are sealed at their edges;

a guide path formed within the sheet metal body by pressing and sealing the facing walls together to form guide seams in spaced positions along the length of the body, said guide seams extending alternately from respective edges over a substanial portion of the sheet metal body width;

wherein the sheet metal body is folded in a wave shape to form a plurality of lengthwise channels for passage of a cooling medium.

2. An oil cooling arrangement according to claim 1, wherein said oil cooler is provided with flow openings in the guide means between adjacent channels for passage of the cooling medium.

3. An oil cooler according to claim 1, wherein said oil cooler has an inlet opening and an outlet opening on a common horizontal planer surface of the folded sheet metal body.

4. An oil cooling arrngement according to claim 3, wherein said inlet and outlet openings are connected to connection fittings located in a wall of the water tank.

* * * * *